US006659337B2

(12) United States Patent
Woelfel

(10) Patent No.: US 6,659,337 B2
(45) Date of Patent: Dec. 9, 2003

(54) UNIVERSAL MAILBOX FLIP-FLAG INDICATOR

(75) Inventor: Michael B. Woelfel, Kingwood, TX (US)

(73) Assignee: Michael Bob Woelfel, Kingwood, TX (US)

( * ) Notice: Subject to any disclaimer, the term of this patent is extended or adjusted under 35 U.S.C. 154(b) by 0 days.

(21) Appl. No.: 10/061,050

(22) Filed: Jan. 31, 2002

(65) Prior Publication Data

US 2002/0158117 A1 Oct. 31, 2002

Related U.S. Application Data

(60) Provisional application No. 60/264,586, filed on Jan. 29, 2001.

(51) Int. Cl.[7] ..... B65D 91/00
(52) U.S. Cl. ..... 232/35
(58) Field of Search ..... 232/35, 34

(56) References Cited

U.S. PATENT DOCUMENTS 3,207,427 A * 9/1965 Madewell ..... 232/35
3,391,861 A * 7/1968 Seckler ..... 232/35
3,866,823 A * 2/1975 Grayson ..... 232/35
4,805,834 A * 2/1989 Saba ..... 232/34
5,094,386 A * 3/1992 Tabacco ..... 232/35

* cited by examiner

*Primary Examiner*—William L Miller

(57) ABSTRACT

A universal mailbox signal device is provided to visually indicate mail is delivered. A detachable component is comprised of a wide flag element attached to a flat resilient nylon stem. Upon installation in a mailbox, the straight stem is bent and shaped as needed to conform to one of the many mailbox configurations available. The stem can also then be twisted to adjust the flag in a desired viewable direction. The other end of the stem will slide into a channel in an adhesively mounted base-plate on the inside of the mailbox door. The stem/flag assembly may be removed when absent to prevent an activated, non-attended flag posing a possible security problem. When mail is deposited the flag flips into view and is held firmly at the pre-adjusted viewing angle by the closed door. When mail is retrieved one hand is used to tuck in the flag and close the mailbox door.

7 Claims, 1 Drawing Sheet

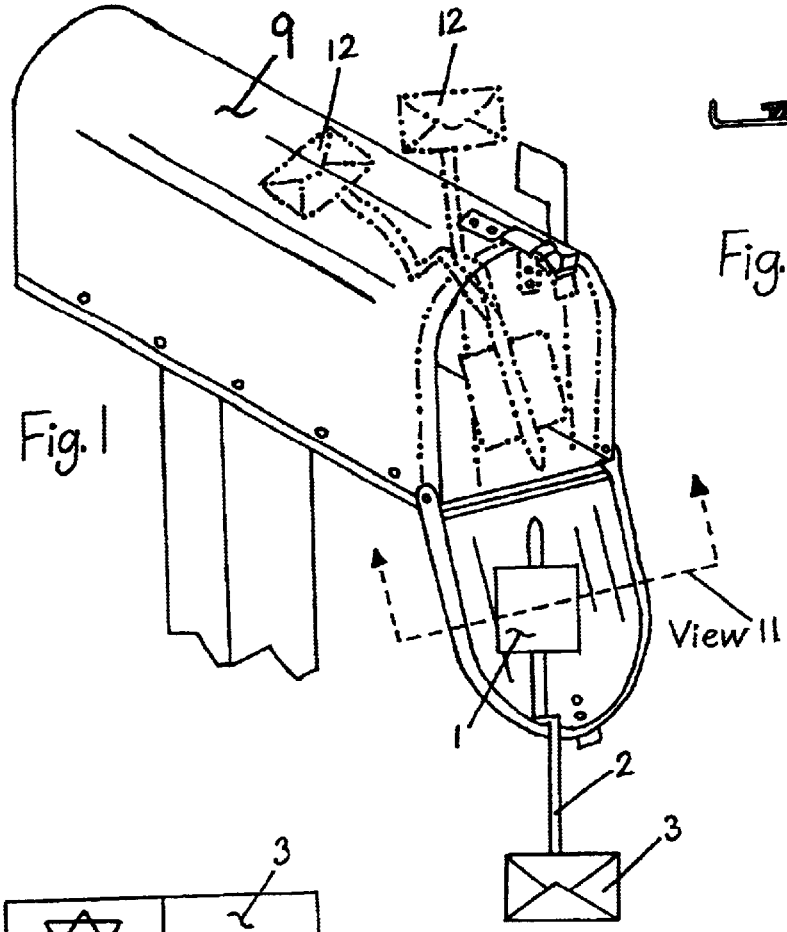
Fig. 1
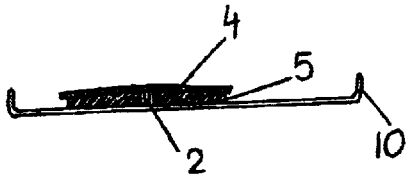
Fig. 4 (View 11)
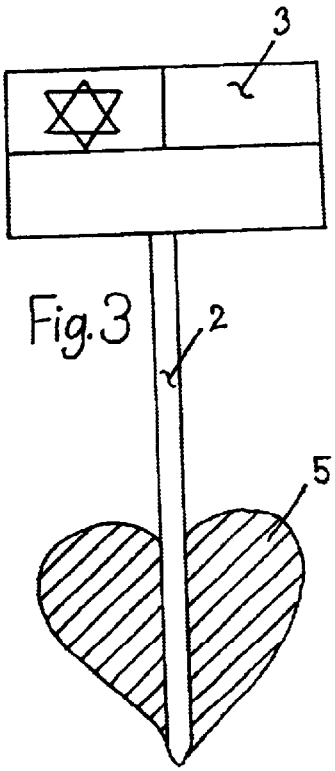
Fig. 3
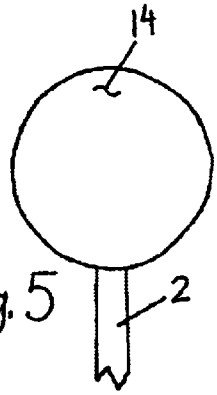
Fig. 5
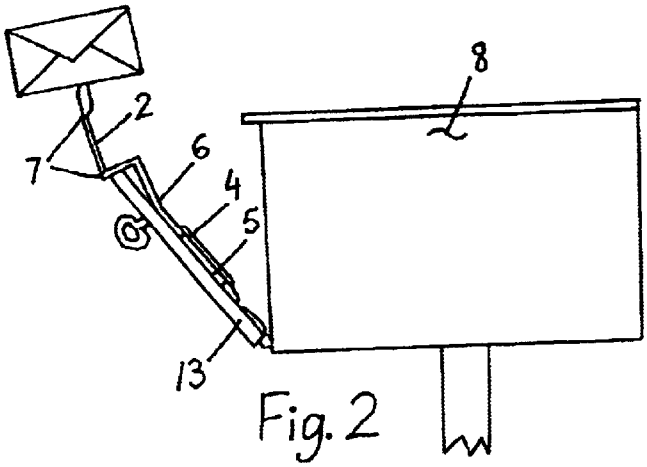
Fig. 2

UNIVERSAL MAILBOX FLIP-FLAG INDICATOR

CROSS-REFERENCE TO RELATED APPLICATIONS

This applications claims the benefit of Provisional Application No. 60/264,586, filed Jan. 29, 2001.

FEDERALLY SPONSORED RESEARCH

Not applicable

SEQUENCE LISTING OR PROGRAM

Not applicable

1. Background—Field of Invention

This invention relates to a mailbox delivery flag, more particularly to a detachable flag device used to indicate a mail deposit has been made.

2. Background—Description of Prior Art

Roadside mailboxes normally lack means of an automatic visual indication that mail has been deposited. Numerous designs for signal devices have been conceived to accommodate the many mailbox styles available. However, the rigidity and/or functional complexity of current devices limits them from being widely adaptable to more than a few mailbox types.

Moreover, another common deficiency among mailbox signal devices is their inability to be removed or neutralized easily. Such a mail indicator could become a security threat. Should a mailbox owner be away more than a day, an activated signal flag would become a constant display of non-attendance and presumed absence.

Finally, current mailbox signal devices observed by this inventor are not simple to reset/retract for the next use. The purpose of a mailbox is primarily to provide a retrieval point for delivered mail. There is therefore a needful use for one hand to extract and hold the mail. This necessitates that a more helpful flag indicator invention should include the ability to permit both closing of a mailbox door and retracting/resetting of a flag with the one remaining hand alone.

One example of a patent that could become a security threat is U.S. Pat. No. 4,805,834 to Saba, Feb. 3, 1989. It is both permanently installed and unable to be deactivated or easily removed. With this flag device installed, a mailbox owner has few options but to hope no one will trigger the flag within the duration of his/her absence. Additionally, the Saba signal device has a rigid joggle bend, which would limit its use to only mailboxes with a door-to-cavity fit accommodating that shape.

Another example of an invention limitation typical of so many mailbox signal devices is the U.S. Pat. No. 4,190,193 to Smith, Feb. 26, 1980. The rigid shape of this invention limits its application to only mailboxes having the preformed clamp size and shape. However, it seems apparent that even the target shape and sized mailbox could not be fitted with the Smith patent if the mailbox were bricked in, as the fashion of some owners is to do.

Lastly, the U.S. Pat. No. 4,390,122 to Savko Jun. 28, 1983, typifies an invention inconveniently requiring both hands to retract/reset the flag while closing the mailbox door. Also this signal device would be difficult to remove and has no deactivation feature. It could pose a security threat for an owner during his/her sustained absence as well.

OBJECTS AND ADVANTAGES

Accordingly, an object and advantage of my flag indicator is a removable stem/flag assembly. This facilitates a mailbox owner with an additional option to prevent the security risk posed by an unattended mail flag display during his/her absence. Phoning the post office to defer mail delivery may sometimes not be practical or may, for various reasons not always be heeded.

Other objects and advantages of my flag indicator include a more universal fitting capability. It can be easily shaped upon installation to fit a variety of mailbox designs, including those enclosed in brick. This is accomplished with an internally mounted base-plate, which can be affixed, with no hardware, to a flat surface of a hinging mailbox door. In addition, the stem of the removable flag assembly will hold a shape when crimped or twisted enabling an owner to conform the flag to most any closable roadside mailbox including the more odd shaped and home built boxes. The stem consists of nylon as of an electrical cable tie, and can also be cut to length by an installer. It is weather resistant, will not scratch paint, or pose an eye hazard to shorter persons that the more rigid flags might do.

Additionally, an object of this mailbox indicator is to provide for one-handed retracting/resetting of the flag as the door is closed after the mail is removed. In most mailbox installations this feature can be achieved. However, since each flag is custom fitted, one-handed reset/closure cannot be guaranteed in all applications. Use of a soft nylon stem lends itself more readily to single-handedly resetting the flag in most installations because a short flag to base-plate connection can be made without overstressing the adhesive means attaching the base-plate when the flag gets tucked into the mailbox. The arc that the stem makes when tucking in the flag can be made short enough, in most installations, to allow closure of the mailbox door with the palm against the door and the fingers curled over the edge and onto the stem, and still maintain enough downward control on the stem to both fit the flag into the cavity and close the door with one hand. An additional mid-span permanent bend on the stem contributes to relieve some stress on the base-plate adhesive means without the stem hindering door closure or fit. Instructions would be included in the final product packaging to fully clarify installation capabilities, options, and limitations for the mailbox owner. Further objects and advantages of my flag indicator will become apparent from a consideration of the drawings and ensuing description.

SUMMARY

Roadside mailboxes come in numerous sizes and shapes but have no signaling capability when mail is deposited. The mail delivery signal devices currently available lack the custom fitting and installation capabilities required to be broadly marketed. My Universal Flip-Flag Indicator invention is simple to install, easy to operate, and can be universally adaptable to most roadside mailboxes. The stem can be cut to size, twisted, and crimped as needed to fit most any mailbox and desired viewing position, while still permitting a one-handed flag reset and door closure capability in most installations. In addition, this invention can be easily removed from a mailbox and thus avoid the security risk posed by an indicating flag undesirably displayed during an owners absence.

DRAWINGS

Drawing Figures

In the drawings, all items in each figure have an individual number.

FIG. 1 shows the most common mailbox configured with the Universal Flip-Flag Indicator. It also gives phantom views with the door up both with mail delivered (flag up) and not delivered (flag tucked in).

FIG. 2 shows a home-made mailbox configured with the flag indicator with details of components. Details concerning installation and function are shown from this figure.

FIG. 3 shows the preferred embodiment of the flag device unformed and unattached.

FIG. 4 shows a cutaway view of the mounted flag details of FIG. 1.

FIG. 5 shows a sports ball mounted on a stem.

| Reference Numerals In Drawings | |
|---|---|
| 1 base-plate | 8 homemade mailbox |
| 2 stem | 9 common mailbox |
| 3 flag | 10 mailbox door (cutaway) |
| 4 side view-base plate | 11 cutaway view of FIG. 1 |
| 5 thick adhesive means | 12 phantom flag |
| 6 mid-stem bend | 13 homebuilt mailbox door |
| 7 adjustment of stem (2 plcs) | 14 sports ball |

DETAILED DESCRIPTION

Description—FIGS. 1–5

A preferred embodiment of the flag indicator is shown in FIG. 3. This view shows the resilient stem 2 fitted with a weather-resistant flag 3 and held between the non-adhesive edges of adhesive means 5 which cover the surface of a heart shaped base plate (not shown). The stem 2 is straight, as it would be before it was installed on a mailbox. When installed it would be shaped to conform to the door closure features (not shown), and twisted to set a preferred viewing angle for the flag 3.

FIG. 4 shows a view of the door cutaway along directional line 11, FIG. 1. This detail view shows two parallel adhesive means 5 sandwiching stem 2 (within non-adhesive edges). A frictional hold on stem 2 also occurs by the surrounding channel, sandwiching stem 2 between the base plate 4 and the mailbox door 10. The friction is due to the adhesive means 5 being slightly less thick than the stem 2. When stem 2 is installed it will therefore cause a slight bulge in base-plate 4 away from mailbox door 10. FIG. 5 shows a sports ball 14 mounted on a stem 2.

Details of FIG. 1 show a complete mailbox 9 fitted with a flag indicator 1,2,3. The phantom images are of a flag 12 tucked in and prepared for a mail delivery and a flag 12 erect and signaling a deposit has been made in box 9.

A home-built mailbox 8 is shown in FIG. 2. It is fitted to show another application of flag indicator 2,3. This side view illustrates more capabilities for installing the device. A 90 deg. twist of stem 2 at the upper fixed bend 7, below flag 3, provides an owner a line of sight of the flag viewed from the street. Base-plate 4 sandwiches stem 2 to door 13 with adhesive means 5. This view shows a mid-stem 6 obtuse angle bend used to relieve some stress on adhesive means 5. With this bend in place adhesive means 5 will not be pulled as hard from mailbox door 13 by stem 2 when tucked into mailbox 8 with door 13 is closed. While door 13 is closing upon stem 2, when mail is delivered, stem 2 slides up the upper cavity edge of mailbox 8 until the preformed shape of stem 2 matches the closure shape. Stem 2 has enough firmness to consistently meet its preformed position regardless of the speed the mailbox door 13 is closed. Single handed tucking capability is determined by the length portion of stem 2 that rises above the custom joggle bend. The greater the length of stem 2 required outside a mailbox (in order to see flag 3 from behind a bricked-in mailbox a greater length of stem 2 is required, for instance), the greater the length of stem 2 will be required to remain inside mailbox 8 fitted behind base-plate 4. A gradual arc is necessary to prevent overstressing adhesive means 5. A general rule for installation is to cut stem 2 to a length twice what is needed above a door 13 closure joggle to meet the particular installation viewing goals. Then simply add the width of all joggles to the over all length and balance the shaping bends of stem 2 in the middle. The arc of stem 2 will not be equally divided (stem 2 remains straight behind base-plate 4), but overall it will not stress base-plate 4 or adhesive means 5 adversely. A stem 2 length of 6 to 10 inches can still facilitate mailbox door 13 being closed with one hand. Most mailboxes need no more than 2–4 inches of flag/stem outside to be viewable.

Accordingly, the reader can see that installing roadside mailboxes with this flag indicator can save time, otherwise wasted checking empty mailboxes and watching for a daily mail carrier. Having at-a-glance convenience with regard to mail delivery eliminates one of life's hassles and a contributor of stress. Although the description above contains many specificities, these should not be construed as limiting the scope of the invention but as merely providing illustrations of some of the presently preferred embodiments of this invention. For example, the base-plate may be attached with a hook and loop type of fabric, or one of the silicones or epoxies available today.

I claim:

1. A signal device affixed to the inside of a mailbox door with said door hingeably connected to a mailbox body having a cavity opening such that said door is closeable against said cavity of said mailbox body, said device comprising: a resilient stem element consisting of a formable material having at a free end an indicating element, said stem being frictionally held at the opposite end of said free end within a channel formed by a base-plate affixed to the inside of said mailbox door, said base-plate having two parallel adhesive means of a predetermined thickness which are gapped to form said channel such that non-adhesive inside edges of said adhesive means frictionally sandwich said stem in between and against said mailbox door such that said stem may be slidably detached and slidably replaced at will.

2. The signal device of claim 1 wherein said stem is a portion of an electrical tying device and constitutes a new use for said electrical tying device providing a formable means for accommodating said mailbox door when against said mailbox body.

3. The signal device of claim 1 wherein said stem protrudes out from between said base-plate and said mailbox door, out of said mailbox body to be formed by crimping, twisting or other shaping means such that said stem conforms when erect and sandwiched between said mailbox door and said mailbox body when said mailbox door is closed against said mailbox body.

4. The signal device of claim 1 wherein said signal device is adapted to cooperate with other mailboxes.

5. The signal device of claim 1 wherein said indicating element constitutes a national flag.

6. The signal device of claim 1 wherein said indicating element constitutes a state flag.

7. The signal device of claim 1 wherein said indicating element constitutes the likeness of a sports ball; whereby a person can be remotely apprised of a mail deposit by said signaling device which is capable of being custom fitted to said mailbox door and is removable to avoid a possible security threat during an absence.

* * * * *